US006012374A

United States Patent [19]

Brandl et al.

[11] Patent Number: 6,012,374

[45] Date of Patent: Jan. 11, 2000

[54] AUTOMATIC COMBINATION RIFLE

[75] Inventors: Rudolf Brandl, Dornhan; Heinz Matt, Oberndorf, both of Germany

[73] Assignee: Heckler & Koch GmbH, Germany

[21] Appl. No.: 08/994,341

[22] Filed: Dec. 19, 1997

Related U.S. Application Data

[63] Continuation-in-part of application No. 08/755,401, Nov. 22, 1996, abandoned.

[30] Foreign Application Priority Data

Dec. 19, 1996 [DE] Germany ..... 196 53 194

[51] Int. Cl.[7] ..... F41A 19/19

[52] U.S. Cl. ..... 89/1.41; 89/127; 89/33.04; 89/148; 42/70.08

[58] Field of Search ..... 89/1.41, 127, 126, 89/33.04, 148; 42/70.08, 42.01 APS, 42.03 FOR

[56] References Cited

U.S. PATENT DOCUMENTS

| | | | |
|---|---|---|---|
| 1,202,707 | 10/1916 | Grieco | 89/126 |
| 1,339,867 | 5/1920 | Strickland | 42/42.01 |
| 1,487,801 | 3/1924 | Pedersen . | |
| 3,757,446 | 9/1973 | Vesamaa | 42/42.01 |
| 4,679,486 | 7/1987 | Landaas | 89/126 |
| 4,867,039 | 9/1989 | Dobbins | 89/127 |
| 4,882,973 | 11/1989 | Piscetta | 89/1.41 |

FOREIGN PATENT DOCUMENTS

| | | | |
|---|---|---|---|
| 148516 | 1/1937 | Austria | 89/126 |
| 0 294 346 | 12/1988 | European Pat. Off. | 89/1.41 |
| 565530 | 11/1944 | United Kingdom | 89/127 |

*Primary Examiner*—Stephen M. Johnson
*Attorney, Agent, or Firm*—Leydig, Voit & Mayer, Ltd.

[57] ABSTRACT

An automatic combination rifle with a large caliber automatic rifle system and a normal caliber automatic rifle system that include respective triggering arrangements which are connected with a single, movable trigger lever with the use of an activated change-over mechanism. Each triggering arrangement comprises a movable release mechanism to control the respective trigger function. The change-over mechanism establishes a selective connection with one of the release mechanisms for cooperative movement with the trigger lever.

4 Claims, 6 Drawing Sheets

AUTOMATIC COMBINATION RIFLE

CROSS REFERENCE TO RELATED APPLICATIONS

This application is a continuation-in-part application of application Ser. No. 08/755,401, filed Nov. 22, 1996, now abandoned the subject matter of which is incorporated herein in its entirety.

FIELD OF THE INVENTION

This invention relates generally to the weaponry art, and more particularly to a rifle construction with laterally spaced firing systems adapted for firing conventional and non-conventional cartridges. In particular, the firing systems are selectively coupled to a single movable trigger lever.

BACKGROUND OF THE INVENTION

A user of a firearm often encounters different firing needs in different situations. It is therefore desirable that a singular weapon be adapted to fire different types of ammunition and to enable selection of an appropriate ammunition type depending on the particular situation. In the past, various hunting rifles were configured to combine several barrels of varying size in the form of "drop barrel bundles." Such hunting rifles offer the user the possibility of using different cartridges for different types of game. However, one significant drawback of these arrangements is that no repeating mechanism has been developed for use with the barrels of such rifles.

Repeating mechanisms, of course, are a desirable feature in rifles, particularly when used as assault weaponry. Prior attempts therefore combined a repeating rifle designed for firing conventional or normal-caliber cartridges with an additional barrel designed for large-caliber cartridges, such as buckshot cartridges. These known arrangements, however, are generally cumbersome, complicated in operation, and expensive. As a result, they have not experienced a great degree of popularity, and their use has been generally restricted to collectors and the like.

Perhaps the only weapon of this kind which has come into relatively widespread use is a standard assault rifle equipped with a grenade launcher barrel mounted thereon, an example of which is described in German patent DE 32 02 806 C2. This document describes an assault rifle barrel and firing system that is primarily utilized. A relatively short grenade launcher barrel is mounted to the distal end of the shaft portion of the rifle barrel. The grenade launcher barrel is equipped with a separate breech block and trigger assembly. This arrangement further includes a special sighting arrangement designed for use in conjunction with the grenade launcher barrel and is mounted proximate to the normal sighting arrangement for the assault rifle. This assault rifle/grenade launcher combination, however, is quite cumbersome. Due to size and weight considerations, the grenade launcher barrel must be considerably shorter than the rifle barrel. The grenade launcher reloading sequence and mechanism is likewise rather complicated.

In addition to its inconvenience in use, this arrangement also provides unsatisfactory recoil impact. Due to the significant distance separating the normal-caliber rifle barrel and the grenade launcher barrel, it is difficult to achieve optimized recoil characteristics for both barrels. For example, when the position of the normal-caliber rifle barrel is arranged so that the recoil force is transferred in a desirable manner to the shoulder of the user, the recoil force generated by the grenade launcher is transferred in an unsuitable manner. The heavy weight, inconvenient handling, and unbalanced recoil impact are principle reasons that such a combination rifle is unpopular with operators, and as a result is rarely used.

Although past efforts to combine rifle barrels of different calibers generally have produced unsatisfactory results, the need for such combination weapons remains. For example, large-caliber rifle cartridges that deploy so called "intelligent ammunition" have been developed. As used herein, "intelligent ammunition" is intended to mean a type of ammunition which, possibly in cooperation with a guidance system mounted on the weapon, automatically locks onto a target, thereby providing considerably improved targeting accuracy. If a weapon for firing such "intelligent ammunition" can be effectively combined with an assault rifle, the resulting weapon can be very versatile and very powerful.

Similarly, single triggers in weapons having a single breech and two firing pin pieces are also known in the art. In sport shooting rifles for clay pigeon shooting, for example, they are designed to permit firing of one barrel while the firing pin piece pertaining to the other barrel is automatically released. Also, a signaling pistol is known in the art where a change-over lever offers the options of firing any barrel or both barrels at the same time.

In weapons with two completely separate systems using different cartridges and each having its own respective breech which is independent of the breech of the other system (also see U.S. Pat. No. 1,487,801), each system is naturally equipped with its own trigger.

SUMMARY OF THE INVENTION

Accordingly, it is a general object of the present invention to provide a self-loading rifle that is capable of firing cartridges of different sizes in various operative modes and that is relatively simple in construction and in use, easy to handle, to provide a greater degree of self-defense as compared to known weaponry.

It is an additional object of the invention to provide a self-loading combination rifle capable of firing both normal-caliber and large-caliber cartridges in alternative modes of operation and that permits the user to switch easily from the different modes of operation.

It is another object of the present invention to provide a self-loading combination rifle for firing both normal-caliber and large-caliber cartridges that has optimized recoil characteristics regardless of the cartridge type being fired.

It is an object of the present invention to provide a self-loading combination rifle for firing both normal-caliber and large-caliber cartridges that has a simple structure and is relatively lightweight so that the rifle is easy to manufacture, simple to maintain and convenient to carry.

It is a related object of the present invention to provide a self-loading combination rifle that has a relatively simple triggering mechanism and a straightforward sighting arrangement.

It is another object of the invention to further develop a combination rifle that provides a simple and reliable single trigger arrangement.

It is yet another object of the invention to provide a selection mechanism for the single trigger arrangement that is located at a position that is simple and easy to feel and see.

Finally, it is an object of the invention to provide adjustment selection mechanism that is operable in the same manner for both right-handed and left-handed individuals.

In accordance with these and other additional objects, a combination rifle construction of the present invention comprises a first longitudinally extending barrel, and a second longitudinally extending barrel laterally spaced from the first barrel, and a housing adapted to receive the barrels. The rifle includes a first automatic or self-loading system disposed to load conventional cartridges into the first barrel in a first operative mode. A second self-loading system is similarly disposed to load non-conventional cartridges into the second barrel in a second operative mode. In the preferred embodiment, the first and second rifle barrels are substantially parallelly disposed and closely adjacent each other. This arrangement permits the use of a single trigger that is switchable between the first and second rifle loading systems. In addition, a single sighting apparatus may be utilized in both operative modes.

One of the features of the invention is that the resulting weapon provides rifle barrels of different bore diameters, each with a dedicated self-loading system, included within a single housing. The weapon may be used as both a military large-caliber rifle and as a conventional assault rifle in a relatively lightweight construction.

Another feature of the invention is that both rifle systems are disposed in a ready-to-use position, so that the operator may readily switch from one rifle system to the other without undue delay or effort. Thus, the operator can wield a single weapon which provides the versatility and freedom of choice of multiple weapons.

The above and other additional objects are further provided with an automatic combination rifle having first and second trigger arrangements. Each of the trigger arrangements is equipped with a movable release to control the triggering function of a respective firing system. A change-over mechanism is operatively connected with a selected one of the release mechanisms for cooperative pivoting movement with the movable trigger lever.

According to a principle of operation of the invention, each of the respective trigger arrangements has one part upon which an activating finger or "trigger lever" acts. In addition, each trigger arrangement has a "release," which is acted upon by the remaining triggering device. The one-piece trigger, comprising the release and the trigger lever is pivotally mounted on an axle so that the release also pivots about this axle.

Other objects and advantages will become apparent with reference to the following detailed description when taken in conjunction with the drawings, in which:

Figures 1, 2, 3, 4, 5, 6, 7:
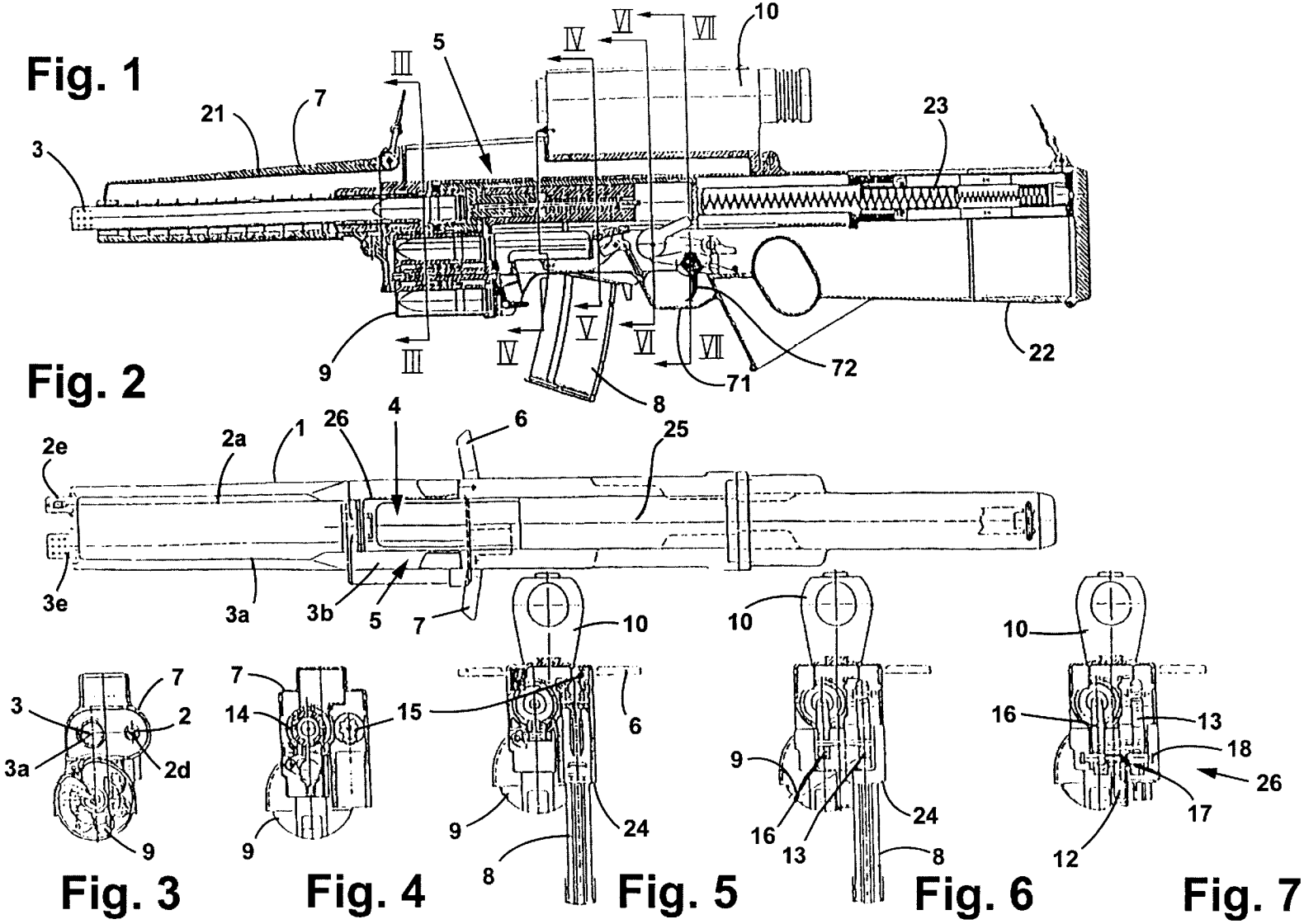
FIG. 1 is a side view of one preferred embodiment of a rifle construction according to the present invention in a first operative mode.
FIG. 2 is a top view of the rifle construction of FIG. 1.
FIG. 3 is a section view of the rifle construction of FIG. 1 taken along the lines III—III.
FIG. 4 is a section view of the rifle construction of FIG. 1 taken along the lines IV—IV.
FIG. 5 is a section view of the rifle construction of FIG. 1 taken along the lines V—V.
FIG. 6 is a section view of the rifle construction of FIG. 1 taken along the lines VI—VI.
FIG. 7 is a section view of the rifle construction of FIG. 1 taken along the lines VII—VII.

While the invention is susceptible of various modifications and alternative constructions, certain illustrated embodiments hereof are shown in the drawings and will be described below. It should be understood, however, that there is no intention to limit the invention to the specific embodiments disclosed herein. To the contrary, the invention is intended to cover all modifications, alternative constructions and equivalents falling within the spirit and the scope of the invention as defined by the appended claims.

DETAILED DESCRIPTION OF THE PREFERRED EMBODIMENT

Generally, the invention relates to a combination rifle of a type including a large caliber automatic rifle system, designed to permit precise target fire over a significant distance, is laterally disposed from a normal caliber automatic rifle system, primarily intended for the rifleman's self-defense. The normal caliber system is designed for rapid fire or for bursts of fire where the number of shots can be predetermined. On the other hand, the large caliber system is designed for shotgun cartridges or similar and thus does not meet high requirements in terms of precision shooting.

In order to permit firing precise shots in one embodiment, the position of the trigger is preferably optimized. This is of less significance when shotgun cartridges or similar are fired. The position of the rigger is also preferably optimized for firing rapid fire in order to permit the weapon to be held and aimed easily. Alternatively, the trigger in the shotgun system may be suboptimal, and therefore, two triggers may be employed although it is preferably equipped with only one single trigger. Depending on the requirements, the single trigger is selectively connected to one or the other firing system, while retaining a position that is optimal.

FIGS. 1 and 2 show a combination rifle construction embodying the present invention. The rifle comprises first and second rifle firing systems adapted to fire cartridges of different calibers. In this regard, the rifle comprises a unitary housing 1 adapted to receive longitudinally extending first and second barrels 2, 3 received within complemental recesses formed in the housing. In the preferred embodiment, the distal ends of respective barrels 2, 3 project somewhat beyond the housing end. The housing 1 is formed to provide a hand guard 21 at one of its ends and a shoulder support or stock 22 at its opposite end. A recoil spring 23 disposed within a recess formed in the shoulder support 22 aids in the absorption of recoil forces generated by the weapon during firing.

FIG. 1 also shows a trigger assembly 11 depending from the housing intermediate the hand guard and the shoulder support 22, including a corresponding trigger 12. A magazine shaft 24 (FIGS. 5 and 6) disposed proximate to the trigger 12 is adapted to receive cartridge magazines containing conventional or normal caliber cartridges. In particular, FIG. 1 illustrates a conventional (slightly curved) magazine 8 containing normal-caliber cartridges. In addition, the rifle is adapted to receive a drum-type magazine 9 containing non-conventional or large-caliber cartridges.

FIGS. 1 and 5–7 also illustrate sighting apparatus 10 mounted to the top side of the housing 1 to facilitate the aiming of the weapon. As described below, the invention is particularly suited for use in military or combat situations as an assault weapon that is readily adaptable to varying uses.

As best seen in FIG. 2, the first and second longitudinally extending barrels 2, 3 have different bore diameters adapted to fire cartridges of different calibers. The first barrel 2 is preferably a conventional or normal-caliber rifle barrel. The second barrel 3 is a non-conventional or a large-caliber rifle barrel. The barrels are preferably parallelly disposed in a side-by-side arrangement on opposed sides of a barrel axis 25. As seen in FIGS. 3 and 4, the respective barrel axes 2*a*, 3*a* are also at least substantially aligned in the same vertical plane. This side-by-side arrangement has several advantages. For instance, the sighting line is equidistant to the bore axes of the respective barrels, thereby simplifying the sighting arrangement. Placement of both of the barrel axes in the same plane also ensures proper clearance when firing from behind obstruction or cover, that is, both barrels will be raised sufficiently over the upper edge of the cover. Another significant advantage of this arrangement is that the bore axes of the respective barrels orient the recoil forces to the same impact area on the shoulder of the user. In this way, the recoil impact characteristics of the rifle can be optimized regardless of the particular barrel in use.

As illustrated in FIG. 2, the distal ends or ejection openings 2*e*, 3*e* of the respective rifle barrels 2, 3 are preferably in alignment with each other, i.e., the barrel ends are substantially the same distance from the butt end of the rifle. The barrel ends 2*e*, 3*e* shown in FIGS. 1 and 2 also illustrate flash dampers attached to the respective muzzles. In this regard, the total length of each barrel includes any flash damper, brake, etc., which is attached to the muzzle of the barrel.

In an alternative construction, the first and second rifle barrels and their respective self-loading systems are arranged such that the first rifle barrel overlies the second rifle barrel. In such an arrangement, the large-caliber rifle barrel should be located in the physiologically favorable position due to its greater weight and stronger recoil forces. When the barrels are disposed in a stacked relation, the cartridges can be fed into the barrels from their respective lateral sides.

The term "rifle barrel" as used herein is intended to denote a barrel which is arranged for direction-controlled firing of a projectile, in contrast to the barrel of a firearm that has relatively poor directional control, such as the cone of a shot gun. The conventional or normal-caliber barrel 2 is preferably sized for firing any one of several common cartridge types such as the .308 Winchester cartridges or the 7.62 millimeter Kalaschnikov cartridges. In the preferred embodiment, the normal-caliber barrel 2 is sized for firing .223 cartridges or cartridges of a similar but possibly slightly smaller size, such as the 5.45 millimeter Kalaschnikov or 4.6×36 (millimeter) cartridges. The advantage of utilizing cartridges of a relatively small size reduces the barrel diameter of the conventional barrel 2, thereby reducing the overall weight of the weapon.

The large-caliber rifle barrel 3 is preferably adapted to fire cartridges of a caliber on the order of 20 to 25 millimeters. As an example, such cartridges may contain intelligent ammunition. The large-caliber rifle barrel 3 is sufficiently sturdy in construction to withstand higher gas pressures than ordinarily generated by shot gun cartridges. Preferably, the large-caliber rifle barrel 3 has spiral rifling in its bore. Alternatively, the invention contemplates use of a large-caliber barrel having a smooth bore or with spaced axial riflings without departing from the spirit and scope of the present invention.

In accordance with a feature of the present invention, each rifle barrel in the combination rifle is provided with its own self-loading system. As illustrated, the rifle has a normal-caliber self-loading system, generally denoted by reference numeral 4 in FIG. 2, disposed proximate to the breech end of the normal-caliber barrel 2. Likewise, a large-caliber self-loading system 5 is disposed proximate to the breech end of the large-caliber barrel 3. The self-loading systems permit easy reloading and firing of the weapon.

In the preferred embodiment, the assault rifle section of the combination rifle includes the normal-caliber barrel 2 and its corresponding self-loading system 4, and operates in a similar fashion to a conventional assault rifle. It is configured for single shot firing, semi-automatic or multiple shot burst firing, and/or fully automatic or continuous firing. These various firing modes are selectable with the employment of a switch arranged in a manner known to those skilled in the art. The large-caliber or non-conventional rifle section, on the other hand, is preferably configured for single-shot firing only. Although the large-caliber loading system may be equipped for continuous firing capability, such a modification is generally impractical in view of the high recoil forces generated upon firing the large-caliber cartridges.

Each of the self-loading systems includes a loading lever and a breech block. As best seen in FIG. 2, a first loading lever 6 extends laterally from one side of the rifle housing proximal to the first barrel 2. Similarly, a second loading lever 7 extends laterally from the opposite side of the rifle housing spaced longitudinally from the second barrel 3. The loading levers 6, 7 are interconnected with the respective breech blocks 14, 15 (see also FIGS. 4, 5). Manual movement of levers 6,7 in a first direction effects operative engagement of the breech blocks 14, 15 with barrels 2, 3 respectively, in order to load the respective self-loading systems, or to unload them by movement of the corresponding levers 6,7 in the opposite direction, or, in the case of a cartridge failure, to "load through". By locating the loading lever adjacent its associated rifle barrel, incorrect handling is avoided.

The invention may be modified to employ a single load lever to effect movement of the breech blocks of both self-loading systems. Such an arrangement, however, renders both loading systems operable at the same time. Under some circumstances, if one system is loaded through, an unfired cartridge in the other system will be ejected. Thus, in the preferred embodiment, each of the self-loading systems has a dedicated loading lever disposed proximate its respective rifle barrel.

As noted above, the respective barrels 2, 3 are arranged parallel and adjacent to each other. The barrels have different lengths corresponding to their respective interior ballistic requirements. In particular, the large-caliber barrel 3 is typically shorter than the normal-caliber barrel 2. Due to the alignment of the distal ends 2*e*, 3*e* of the first and second barrels in the preferred embodiment, the cartridge chambers of the barrels and their associated breech blocks are longitudinally spaced from each other. Preferably, however, the loading levers 6, 7 are arranged so that in the rest position (the ready-to-fire position), they are at substantially the same distance from the butt end of the rifle. In this way, the user can readily familiarize himself with the weapon, since regardless of the particular loading lever being used or whether the weapon is operated with the right or with the left hand, the loading levers are always located at the same distance from the user.

As noted above, each of the normal-caliber and large-caliber self-loading systems includes a detachable cartridge magazine 8, 9 to facilitate rapid reloading. In order to avoid interference between the detachable magazines, the magazines may be arranged on opposed sides of the rifle. In the preferred embodiment, however, the magazines 8, 9 are located on the underside of the rifle. As illustrated in FIGS. 5 and 6, the normal-caliber self-loading system includes a magazine shaft 24 adapted to receive a slightly curved rod magazine 8 depending from the underside of the rifle housing proximate to the trigger assembly 11. The rod magazine 8 can be curved as illustrated or relatively straight, and can be constructed similar to magazines used for conventional assault rifles.

A drum magazine 9 disposed intermediate the rod magazine 8 and the hand guard 1 on the underside of the rifle housing supplies large-caliber cartridges to the large-caliber self-loading system. Placement of the cartridge magazines 8, 9 on the underside of the rifle enhances handleability of the weapon. For example, when the rifle user is marching, the rifle can be carried with its flat side lying against the body of the user. This arrangement is also advantageous since the cartridge magazines are placed at a location where logically expected. The magazines 8, 9 are longitudinally spaced apart from each other to avoid interference. This arrangement takes advantage of the unequal lengths of the first and second barrels 2, 3. That is, when the distal ends of the barrels aligned, the large caliber magazine 9 and self-loading system is disposed in front of the normal-caliber magazine and self-loading system due to the shorter length of the large-caliber rifle barrel 3. Since the drum magazine 9 is offset from the normal cartridge magazine 8, it occupies the full width of the rifle. The distinct magazine types employed and the entirely different magazine fastening arrangements essentially eliminates the possibility of confusing one magazine for the other.

In order to avoid the possibility of confusion and to ensure that the trigger used for each barrel system is located in optimal position, the preferred embodiment utilizes a single trigger 12 that alternatively actuates the respective hammers of the firing systems. In this regard, a switch-over mechanism 26 selectively couples the trigger to either one of the two hammers.

Figure 8:
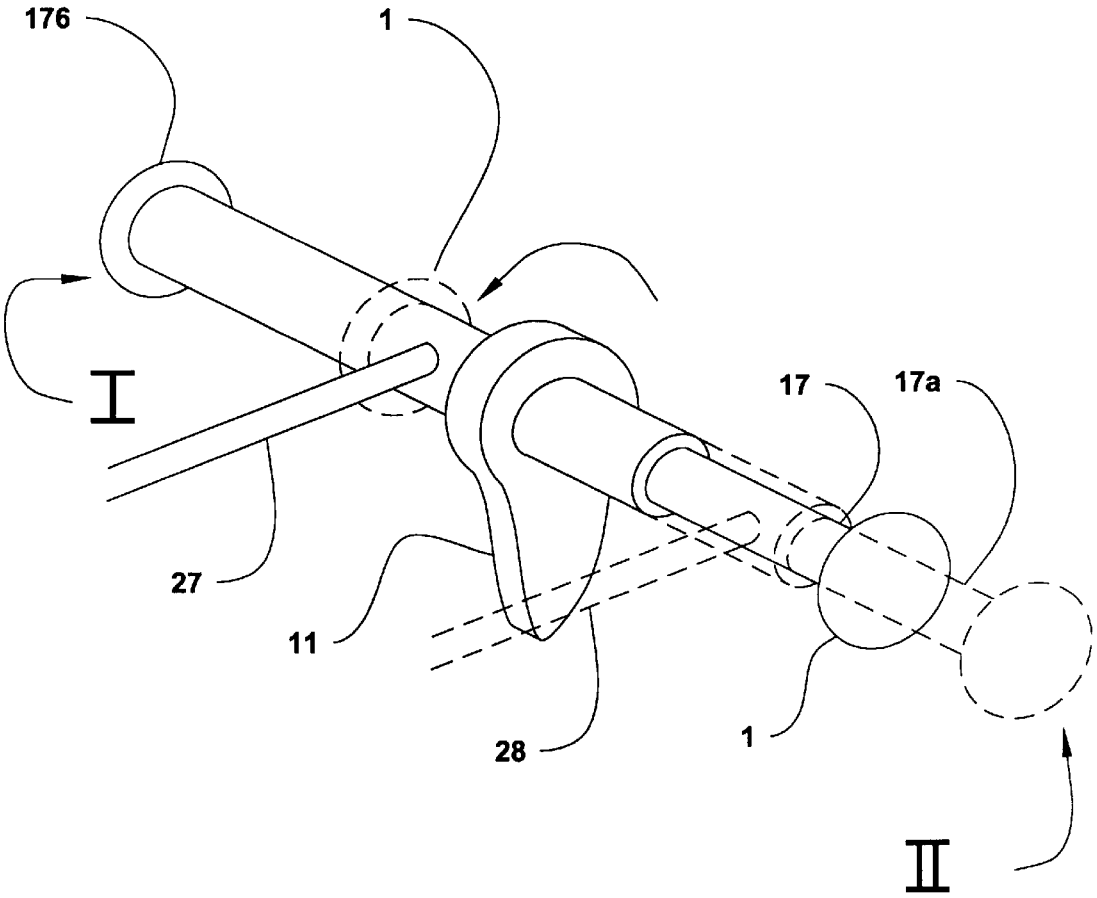
FIG. 8 is a perspective view of a switch-over mechanism utilized in one preferred embodiment of the invention.

As illustrated in FIGS. 1 and 7, the trigger assembly 11 is disposed on the underside of the housing beneath the sighting arrangement 10. The trigger assembly includes the trigger piece 12, a hammer 13 associated with the normal-caliber system, and a hammer 16 associated with the large-caliber system. FIGS. 7 and 8 also illustrate the switch-over mechanism 26 according to the invention in greater detail. In this regard, the hammers 13, 16 are actuated by respective release rods 27, 28. The trigger 12 is pivotally mounted to a switching axle 17, extending through receiving apertures formed in the lateral sides of the housing. The axle 17 also extends proximal to the release rods 27 and 28. A pair of button-shaped heads 17*a*, 17*b* are disposed at each end of the axle 17. The axle is axially slidable between first and second end positions wherein one of the heads is releasably engaged by the housing (e.g., by detents). The axle 17 is somewhat longer than the width of the housing such that, in a first end position, one head 17*a* abuts a side of the housing while the opposed head 17*b* protrudes outwardly from the opposite side of the housing. Similarly, in a second end position, the second head 17*b* abuts the housing while the opposed head 17*a* protrudes outwardly therefrom.

A sleeve which has longitudinally extending teeth located about its outer periphery is fixedly mounted to the axle 17 such that it is axially movable and rotatable therewith. Each of the two releasing rods include complemental apertures configured to match and receive the toothed or geared sleeve such that, in each end position, the sleeve operatively engages the complemental aperture of one of the releasing rods. Thus, in a first end position, the sleeve engages the releasing rod associated with the hammer for the conventional firing system. In the second end position, the sleeve engages the releasing rod associated with the hammer for the non-conventional firing system. In this way, back and forth movement of the shiftable axle between the two end positions alternatively couples the trigger with a selected one of the hammers.

The simple operation of the switch-over mechanism according to one embodiment enables the user to select one of the firing systems while in the firing position. Likewise, as one of the detachable cartridge magazines is emptied, the user is not rendered defenseless until a new magazine can be installed. By merely shifting the switch-over mechanism to the other self-loading rifle system he remains ready to shoot even during a magazine change. For example, if the user empties the normal cartridge magazine while engaged in combat, then he can continue firing by switching to the large-caliber rifle system. The combination rifle of the present invention thus provides the user with greater self-defense capability.

Alternatively, two separate triggers may be employed in conjunction with the rifle barrels as in the case of simple double muskets. Such an arrangement is somewhat more simple in construction.

Turning back to FIGS. 1 and 2, the optical sighting arrangement mounted on top of the housing provides the aiming device for both barrels 2, 3. This is in contrast to the automatic rifle/grenade launcher combination mentioned above which requires two separate sighing devices. Of course, the advantage of utilizing a single sighting device is that it may be located in optimal position for aiming the weapon.

The sighting arrangement 10 preferably includes an optical filter with a graduated plate having a separate scale for each of the two barrels 2, 3 as would be understood by one skilled in the art. Although the barrels are disposed next to each other, the probability of using the incorrect scale for aiming is rather slight. This is because the scale arranged to the right is naturally used for aiming the right barrel, and the scale to the left for the left barrel.

Preferably, a target distance measuring device (range finder) is used in combination with the sighting arrangement to form an optical sighting system. The target distance measuring device preferably is a laser distance meter. The use of the target distance measuring device is advantageous since the large-caliber projectiles fired from the large-caliber barrel tend to have relatively strongly curved trajectory. Of course, precise distance measurements improve the effectiveness of the weapon at greater target distances.

The optical sighting system is configured to automatically adapt its operation in accordance with the rifle barrel and firing system selected by the user. This is achieved, for example, with the employment of a sensor for detecting which of the barrels is selected for firing and generates a signal indicating the same. In the preferred embodiment, the optical sighting system automatically compensates for the distance and the selected rifle barrel to indicate a single point of aim. To that end, an electrical contact sensor connected to the switching axle 17 of the switch-over mechanism is electrically coupled to the optical sighting arrangement. The electrical contact is open or closed depending on the position of the switching axle. This information is used by the optical sighting arrangement to adjust its operation.

It will be appreciated that the combination rifle of the invention packages two different types of weapons in a single housing. The combination rifle can be used in any environment where a military large-caliber rifle or an assault rifle is desired. One of the significant advantages of the combination rifle is that its overall weight is far less than the sum of the weights of a large-caliber rifle and an assault rifle. Although the combination rifle has two rifle barrels, it requires only a single shoulder support and a single hand guard. By utilization of relatively lightweight housing materials commonly used in assault rifles, the weight of the rifle is minimized. Thus, both normal-caliber cartridges and large-caliber cartridges may be fired from a weapon of substantially diminished overall weight.

Moreover, only a single weapon is handled. The user therefore does not have to deal with the inconvenience of handling two separate weapons. Both rifle barrels are in the ready-to-use position, and the user can readily switch from one barrel to the other so that he can decide the type of cartridges to be fired after he has assumed a firing position and immediately before firing.

FIGS. 9 through 16 illustrate a further embodiment of the invention. Pursuant to this aspect of the invention, the trigger does not consist of one single component. Rather, the trigger comprises a trigger lever and a release. Preferably, these components are structurally separate. Each of a pair of triggering arrangements retains its respective release and, when applicable, the trigger swiveling axle. Thus, they are operable as if each had its own trigger. However, a single trigger lever is allocated to the triggering arrangement releases. It is coupled optionally to one or the other release, but never to both at the same time. Accordingly, both triggering arrangements retain the allocated function elements of their respective trigger, namely the release, while the rifle is equipped with only one single trigger lever as the operating element.

This arrangement does not cause any complications or problems in the individual triggering arrangements as they, strictly speaking, remain unchanged. Only the operating element for the triggering arrangement pairs, a trigger lever, which is firmly connected with the release part according to the state of the art, but which does not engage in the actual triggering device mechanism, is available as one piece to be used by both triggering arrangements and can be switched optionally. The inner mechanism of the triggering arrangements does not require any additional or readjusted parts. Therefore, it is not necessary to design special triggering devices. Thus, proven triggering devices can be utilized.

Figure 9:
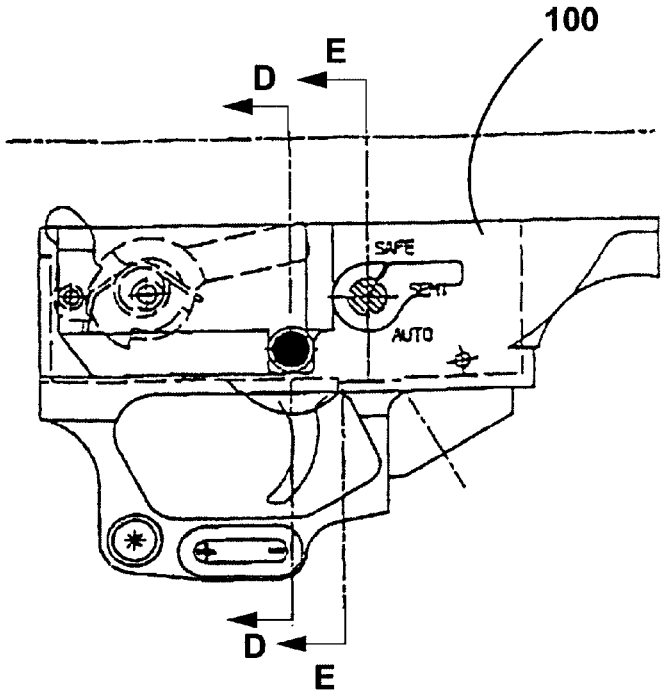
FIG. 9 is a partially cut-away profile of a trigger housing for enclosing a switch-over mechanism according to a second embodiment of the invention.

FIG. 9 shows a portion of a trigger housing 100, preferably made of synthetic material, which houses first and second triggering mechanisms of a combination rifle according to a further embodiment of the invention. In this embodiment, first and second longitudinally extending automatic rifle systems are arranged adjacent each other. The dot-dash line in FIGS. 9, 11, 14 and 15 illustrates the longitudinally extending axes of the respective bores of the firing systems. In these figures, and in FIG. 16, the muzzle is to the left of the componentry shown in the respective illustration.

A first automatic rifle system (shown on the left-hand side in the drawings) is a precision rifle system for an extremely large caliber cartridge with a caliber of 20 mm or above. It is preferably intended for precise firing of grenades or special shells over a distance of several hundred meters. A second automatic rifle system (shown on the right-hand side) is a combat rifle system for a small-caliber cartridge, such as .223 Remington, and is designed for single shot and continuous fire modes of operation.

Each firing system has a respective triggering mechanism. In principle, this triggering mechanism is similar to the triggering mechanism used in the G3 rifle of the German Armed Forces. The second triggering mechanism is equipped with a trigger lever 113 (see FIG. 14) to control operation in a continuous fire mode. The first triggering mechanism is not equipped with this trigger lever 113 (see FIG. 16) as it is designed for single shot fire only.

The trigger housing 100 shown forms a trigger guard with a lower part in which control and operating elements for target optics and electronics may be installed (FIG. 1). The housing also includes an upper portion containing the upper portion containing the components described herein.

A trigger spring of the type known in the art preferably sets the trigger into a neutral position is advantageously also provided for each triggering mechanism in accordance with the invention. Preferably, a trigger spring is allocated to each of the respective releases. Further, a separate additional readjusting spring can preferably be used in conjunction with the trigger lever.

The first and second release mechanisms can be offset in longitudinal direction and they can be spaced apart. In this case, it is necessary to provide an intermediate linkage between the trigger lever and the release, preferably a slide, in addition to the. change-over device. However, each of the triggering mechanisms is preferably designed and arranged such that its respective release and trigger lever are mounted for pivotal movement about a transverse axle. A change-over mechanism selectively establishes a fixed connection between one of the trigger levers and an opposite one of the two releases. With this design, further energy transmitting intermediate links are not required in addition to the change-over mechanism.

In the drawings, the first triggering mechanism is equipped with a first hammer 103 (FIG. 12), a first trigger lever 106 engaged with the hammer 103 (shown tightly hatched in FIG. 15) and a first release 108 mounted for pivoting movement on a transverse axle 109.

The second triggering mechanism is similarly equipped with a second hammer 102 (FIG. 13), a second trigger lever 105 engaged with the hammer 102 (shown tightly hatched in FIG. 14) and a release 107 mounted for pivoting movement on transverse axle 109.

Each release 107, 108 is loaded or biased by a spring (see FIG. 15) such that it normally assumes a neutral position.

Figure 15:
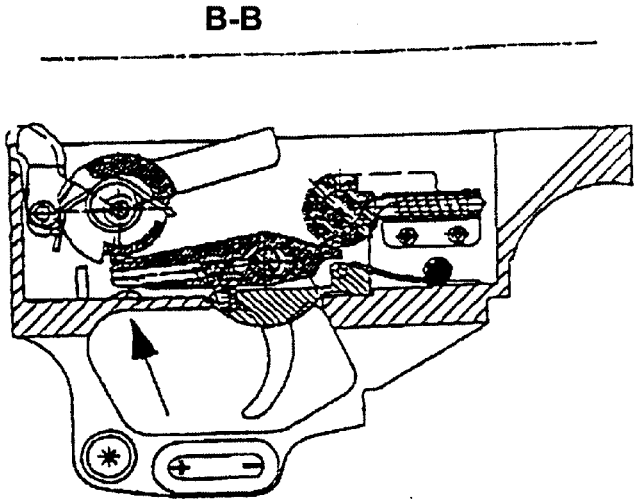
FIG. 15 is a section view taken along the lines B—B in FIG. 12.

Each of the respective trigger levers 105, 106 is supported on a respective one of the releases 107, 108 by a spring. In the neutral position, each of the releases 107, 108 is urged to a position for engagement with a catch located in the respective hammer 102, 103 (FIG. 15).

When either of the releases 107, 108 is pivoted out of the neutral position into a release position (FIG. 14), the release lifts the back of a respective trigger lever 105, 106. The respective hammers 102, 103 are released and are able to strike a pin as is known in the art.

The second trigger lever 105 can be pivoted beyond the release position for operation in a continuous fire mode. Such pivoting movement is not possible for the first trigger lever 106, since it rests on a projection located on the trigger housing 100 when it is in the single shot fire release position (arrow in FIG. 15). Accordingly, thus only single shot firing is possible in the first or large caliber automatic system.

Figure 10:
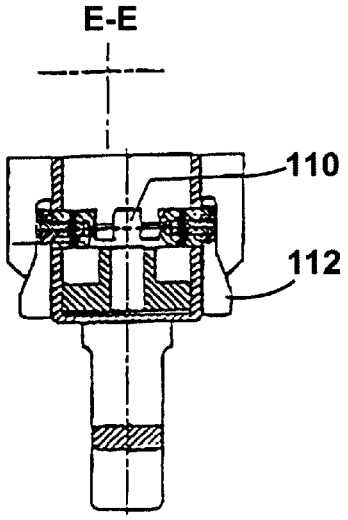
FIG. 10 is a sectional view of the embodiment of FIG. 9 taken along the lines E—E.
Figure 11:
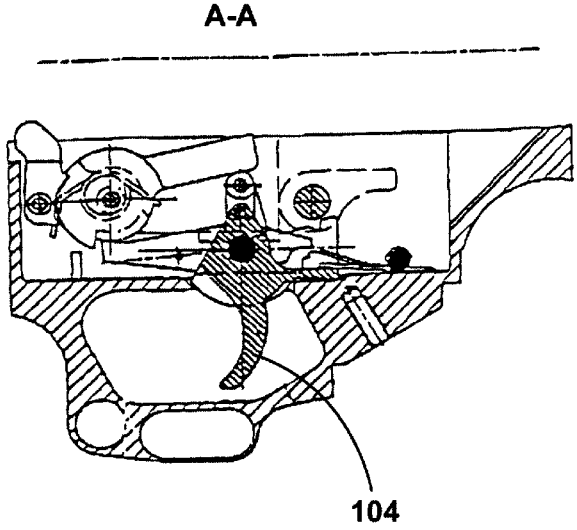
FIG. 11 is another section view taken axially through the center of trigger housing shown in FIG. 9 (along the lines A—A in FIG. 12)

A continuous safety axle 111 traverses both triggering mechanisms (FIG. 10), intersperses both sides of the wall in the trigger housing 100. The safety axle 111 has a safety and fire selection lever 112 disposed at each of its ends (FIG. 10). With each of these levers 112, the safety axle can be adjusted to the positions "safe", "single shot fire (semi-automatic)" or "continuous fire (automatic)". Because of the above mentioned projection (arrow in FIG. 15) the position "continuous fire" is ineffective in the first triggering mechanism.

In accordance with one aspect of the invention, a trigger lever 104 is positioned for pivoting movement on the transverse axle 109, disposed intermediate the first and second releases 107, 108.

The actuating trigger lever axis coincides with the pivot axes of the releases, and thus with the pivot axis of a one-piece trigger provided in a conventional design of the respective triggering device. The trigger lever is activated in the usual manner since it pivots in the usual manner.

In accordance with the invention, a change-over can be accomplished by providing formations on both sides of the trigger lever that are engageable in complimentary formations on each release. Engagement is effected by laterally offsetting the trigger lever such that it catches in an engagement position located on a respective release.

Due to the design of the rifle, the position of the trigger lever would otherwise be somewhat suboptimal at least in one change-over position. In accordance with a particular feature of the invention, it is preferable to design the transverse axle to shift between two end positions in the longitudinal direction of the weapon. In this regard, a section with non-circular cross section engages in each of the end positions both with the trigger lever and with one release for transmitting the moment of torsion.

When the section with non-circular cross section that fits the trigger lever is as long as the thickness f the trigger lever, in transverse direction, both triggering mechanisms may be activated at the same time with the trigger lever.

The transverse axis represents both the axle and the change-over element, which makes the structure according to the invention exceptionally simple. The non-circular cross section axle portion is located in the rifle interior within adjacent parts and thus is well protected from the penetration of dirt or other foreign particles. Insofar as one end of the transverse axle projects from the handle housing, the passage may be designed with a sleeve for providing a tight fit to render the penetration of dirt impossible. However, it is necessary to equip each release with a transverse axle boring, permitting firm engagement with the non-circular section on the one hand, and on the other hand, creating a swivel bedding on a section adjacent to the transverse axle.

The transverse axle, however, is not required to penetrate the housing wall. It can engage in a slide or similar means, which in turn, is connected to an operating element that is mounted in an ergonomically optimized location.

The section with the non-circular cross section may have a projecting bridge element extending from the transverse axle in longitudinal direction of the transverse axle over the section and insertable in a complemental groove in each of the releases. Preferably, however, this section is equipped with several longitudinal grooves distributed over the circumference of the transverse axle to jointly form a serration profile. In the adjacent releases, a multiple groove profile complementing the serration profile is provided. All bridges in this serration profile transmit only very low forces and, therefore, there is no wear and tear.

The bridges of the serration profile are arranged on the outer circumference of the transverse axle to present adjacent smooth sections or spaces of the transverse axle. These sections support the release mechanisms. The spaces between the grooves in the respective release rest on the smooth axle.

When the trigger lever is activated, the release mechanism coupled thereto also pivots, and so does the transverse axle. However, such movement may be inhibited by dried on mud or ice. In this regard, it is advantageous to position a sleeve rotating on the transverse axle supported by shoulders or similar structure on the lateral sides. These likewise have a complementary serration profile or other non-circular profile on their outer circumference because the pivtal or swivel movement is transmitted only via the profiled outer circumference of the non-circular section which engages both in the boring in the trigger lever and in the boring in one of the release mechanisms.

In this regard, the transverse axle 109 has an outer cylindrical configuration with a smooth surface. However, in a central portion thereof, the axle 109 comprises a section with a serrated or grooved profile. Preferably, a plurality of spaced bridges project around the cylindrical surface of the central portion. The length of this serrated profile section corresponds precisely to the thickness of the trigger lever 104.

The trigger lever 104 includes a boring for receiving on the transverse axle. The boring is designed as a multiple groove profile complementary to the serrated profile. Thus, the transverse axle 109 is intended to shift laterally with respect to the weapon (in the longitudinal direction of the axle), but is always connected non-rotating with the trigger lever 104.

Each of the releases 107, 108 is equipped with a groove extending in longitudinal direction of the weapon for housing the trigger levers 105, 106, respectively, which also rests pivoting on the transverse axle 109 and is encompassed on both sides by a leg of the trigger 107, 108. Both legs are provided with a boring with which this release 107, 108 rests pivoting on the transverse axle 109.

The borings in the outer legs of the respective releases 107, 108 and in the respective trigger levers 105, 106 are cylindrical and generally conform to the transverse axle 109 with a slight clearance fit. On the other hand, the borings in the inner legs of the respective releases 107, 108 abut the trigger lever 104. These inner leg borings are equipped with a multiple groove profile that is complementary to the serration profile in the transverse axle 109.

Figure 12:
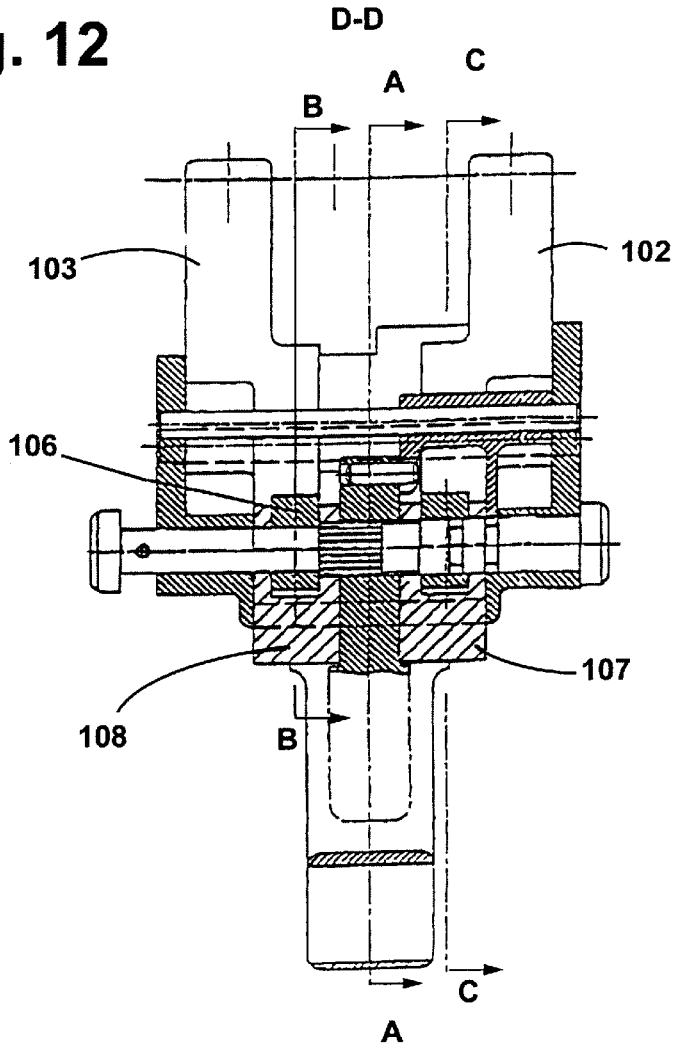
FIG. 12 is an enlarged section view of the trigger mechanism taken along the lines D—D in FIG. 9 illustrating a trigger lever connected with a selected one of a pair of triggering arrangements.
Figure 13:
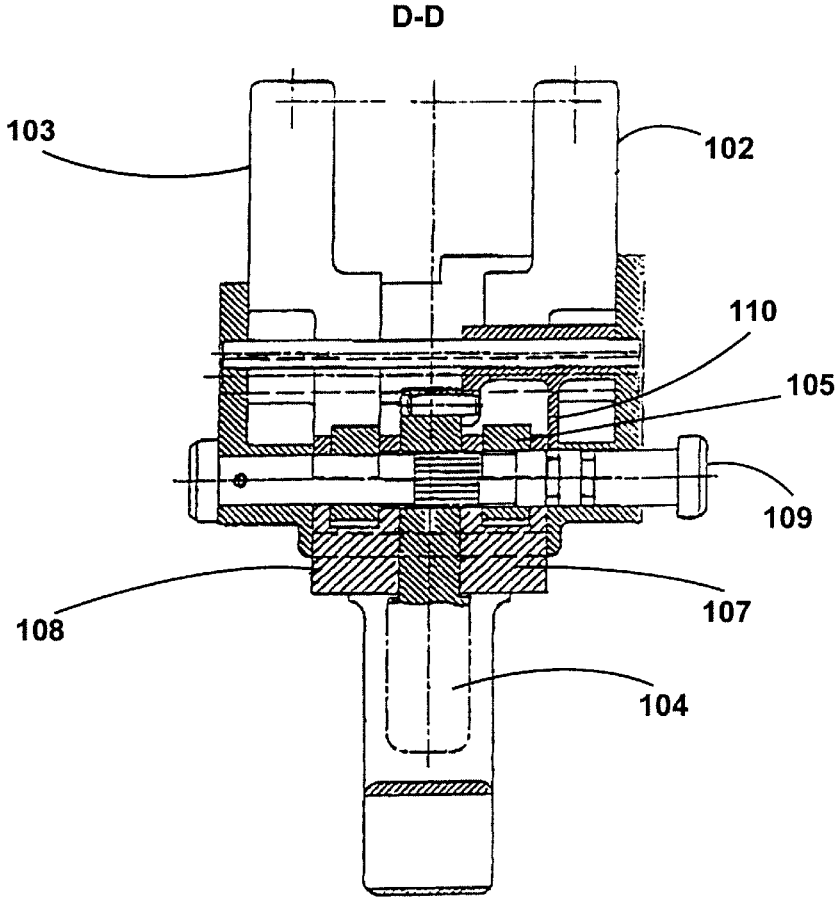
FIG. 13 is another section view taken along the lines D—D in FIG. 1 illustrating the trigger lever connected with another one of the triggering devices.
Figure 14:
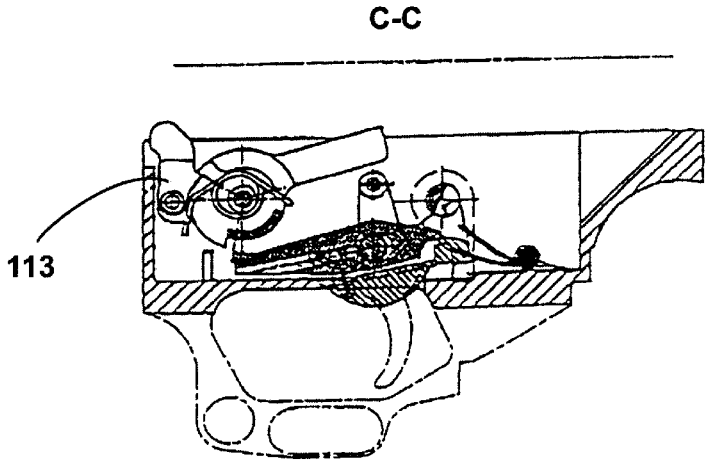
FIG. 14 is a section view taken along the lines C—C in FIG. 12.

If the transverse axle 109 shifts laterally to a left end position, as shown in FIG. 12, then the serration profile interfits with the multiple groove boring in the inner leg of the left release 108. The serration profile also interfits with a portion of the multiple groove boring in the trigger lever 104 for interconnecting the release 108 and the trigger lever 104. In the right end position, as shown in FIG. 12, a non-rotating interconnection between the trigger lever 104 and the right release 107 is established in a similar fashion. If, in one of these end positions, the trigger lever 104 is activated by pivotal movement, then the respective interconnected release 107, 108 pivots jointly with the trigger lever 104, while the other release 108, 107 remains stationary.

It is particularly preferable that, at each end position, a respective end of the transverse axle projects laterally from the handle housing. This arrangement creates a change-over activation button. In this way, the rifle is equipped with a push button on either side of the handle. One of these push buttons is pushed in, and the other is projecting. That rifle system on whose side the push button projects outwardly is the system connected with the trigger lever. Thus, the position of the push button can instinctively be allocated to the respective rifle system, requiring no particular training or thought to determine, reliably and without hesitation, the operating status of the rifle.

The push buttons are located closely above the trigger level and thus within immediate reach and manipulation by the hand that fires the rifle. While the rifle is brought into firing position the system desired or appropriate for the situation can be selected with the result that no time is wasted in the change-over. The rifleman is able to ascertain the position of the push buttons, and consequently the change-over position of the rifle, either by looking or by touch with the hand that grips the handle without release of the grip. Furthermore, it is also possible and advantageous to allocate an electrical contact to the transverse axle and to indicate its position in an electronic target device or a riflescope. In this way, the contact may be used to switch the target device for the appropriate system in operation.

In the preferred embodiment, each end of the transverse axle 109 has a push button which is arranged exterior of the trigger housing 101. In each of the respective end positions of the transverse axle 109, one of the push buttons rests in abutment with the housing outer surface.

Figure 16:
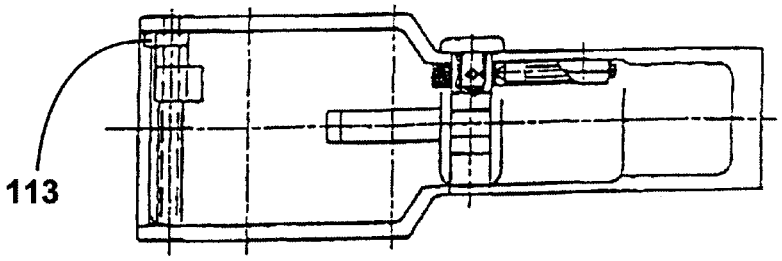
FIG. 16 is a top view of the trigger housing shown in FIG. 9; some parts were left out for better illustration.

The transverse axle 109 described is not designed to be one piece. Rather, the axle 109 preferably comprises several parts: an axle core; and a serration sleeve formed with appropriate grooves or the like so that it may be twisted into position on the axle core to prevent rotation of the serration sleeve when the transverse axle 109 rotates. This prevents the weapon from being inadvertently fired by means of the transverse axle 109. In addition, a catch device, as shown in FIG. 16, prevents the transverse axle 109 from assuming any other position than either one of its end positions.

When the trigger lever is pulled, the projecting push button may be pushed in if the serration profile is in a complementary rotating position with the multiple groove profile of the respective release. In non-pulled position this release is connected with the trigger lever which is in a pulled position and could not be swiveled further. Therefore, it is impossible to pull the triggering device pertaining to this release.

In order to prevent such a possibility it is proposed to provide a blocking element that moves diagonally to the transverse axle by pivoting the trigger lever. The blocking element engages and locks in one of two grooves located opposite in the transverse axle when the trigger lever is activated, and that in each end position one of the grooves is located opposite the blocking element. If the trigger lever is now pivoted to the swiveled position, it is impossible to change-over the transverse axle, and the above described malfunction cannot occur.

In an automatic rifle of the type described in the introduction each of the triggering devices may be equipped with one rotating safety and/or function selection device that is equipped with an operating lever or fire selection lever mounted outside of the respective triggering mechanism. Thus, the rifle has two separate safeties, each of which is allocated to only one single triggering device. If the safety is released from one triggering device, the other safety remains on, even if it was or will be selected.

In order to eliminate such a source for error it is possible to couple the change-over mechanism also with the safety and fire selection device. However, in order to avoid a corresponding complicated design in the most simple manner it is proposed, in accordance with a preferred embodiment of the invention, that the two safety and/or function selection devices are coupled together such that both operating levers are able to activate both safety and/or function selection devices.

This coupling can be accomplished by means of known energy transmission equipment, for example, by means of a flexible shaft. It is preferable, however, to equip the safety and/or function selection devices with a diagonal running, continuous safety axle having an operating lever on each of its free ends. "Safety axle" also means a shell, rod or similar, connecting those ends of two coaxial safety shafts that face each other.

This design is easily achieved if both triggering devices have at least the same basic design. Advantageously, a proven triggering device is used as a module. Therefore, the activation of any of the two activating levers drives the other and puts on or releases, respectively, the safety on both triggering devices at the same time.

The safety axle 111 is located above the transverse axle 109 having two ends that are housed within the trigger housing 101. A blocking element 110 comprising a bearing sleeve and opposed bridge portions extends radially downward from the bearing sleeve. This element is pivotally located on the safety axle.

The bridge adjacent to the upper part of the trigger lever 104 is pivotally connected to the trigger lever 104 by means of a coupling pin which is firmly mounted in the trigger lever 104. The coupling pin engages a groove formed in the bridge. If the trigger lever 104 is activated, then the blocking element 110 pivots in an opposite direction from a neutral position into an engaging position.

In neutral position of the blocking element 110, the lower end of the opposed bridge on the blocking element 110 abuts the transverse axle 109. The transverse axle 109 further comprises two laterally spaced grooves provided on the axle circumference such that in each of the end positions of the transverse axle 109, one of the grooves is located opposite the bridge of the blocking element 110. As soon as the latter is moved to its engaging position the bridge engages the respective opposite circumference groove so that, as soon as the trigger lever 104 pivots the transverse axle 109 cannot be shifted.

On both sides of the trigger housing 101 a safety and fire selection lever 112 is provided, both of which are connected with the safety shaft 111 so that a right-handed individual as well as a left-handed individual can effortlessly activate one of the levers 112. The selected lever 112 position can easily be observed from either side of the rifle.

The operating lever may also control the fire selection, i.e., the adjustment to single shot fire (only one shot per each activation of the trigger lever), a limited number of shots, for example two, in continuous fire (every time the trigger is pulled the respective number of shots is released), or unlimited continuous fire (the rifle fires as long as the trigger lever remains pulled and ammunition is available). Now, however, it is highly probable that the fire selection is not identical in both systems. Firing the large caliber rifle system in continuous fire would not make sense, because the strong recoil already alters the position of the rifle after the first shot to such an extent that the second and subsequent shots would not be able to contribute to fighting the target.

In accordance with the invention, the large caliber automatic rifle system. is designed only for single shot fire. The triggering mechanism for the large caliber automatic rifle system is thus equipped with a stop that limits the change-over to a single shot fire operating mode.

This stop does not inhibit the movement of the safety axle, which can also be in the continuous fire position in the triggering device for the large caliber automatic rifle system. However, it prevents the part that triggers continuous fire from being moved to a release position. "Continuous fire" means any type of fire that is not single shot fire. Thus, if the fire selection lever is in the position for "continuous fire" and the change-over device is switched to the large caliber automatic rifle system, the latter is in single shot fire position, because it is unable to be in a continuous fire position.

A particularly well proven triggering device, such as the one used in the G3 rifle of the German Armed Forces, is equipped with a trigger rod that engages in catching-projections in a hammer and is rotated by a trigger release. The adjustment to continuous fire lengthens the path of rotation of the trigger rod in relation to the possible rotating path for "single shot fire". In accordance with the invention, the trigger housing that contains the triggering mechanism, is equipped with a projection that projects into the moving path of the trigger rod. This prevents the rod from assuming a continuous fire position.

A similar projection may also be provided in other components of the triggering mechanism, i.e., simple constructive obstacle preventing the components that trigger the continuous fire from moving into their continuous fire position, without inhibiting the safety axle movement.

The triggering mechanisms are simple in operation. The triggering mechanism on the projecting side of the respective push button of the transverse axle is currently in operation. To effect a change-over, the transverse axle 109 is shifted towards the opposite housing side and opposite triggering mechanism by urging the push button. This operation can be accomplished in the same manner by right-handed or left-handed individuals. Furthermore, the position of the push button on either side is clearly visible so that a supervisor of the soldier using a rifle of the type described in the introduction is easily able to supervise the switch position.

Various modifications of the invention are also contemplated. For example, rather than releases that are designed for pivotal movement as discussed herein, it is also contemplated that the release may operate by translational movement, rather than pivotal movement. In this case, the trigger lever may be designed for analogous impingement upon the releases.

In addition, it is not absolutely necessary that the trigger lever acting upon the pivoting releases pivots itself. Instead, it can be designed for translational movement in order to impinge on a desired release such that the latter pivots. Also, a swiveling trigger lever can be designed to impinge or act upon a release in order for the release to undergo translational movement.

Accordingly, a combination rifle construction meeting the aforestated objectives has been described. The rifle construction is relatively lightweight, while at the same time, provides ready firing of both conventional caliber and non-conventional caliber cartridges in various operable modes. In addition, the rifle construction permits ready interchangeability between various firing modes.

What is claimed is:

1. A switch-over mechanism used to selectively couple first actuating means of a first self-loading system with a trigger and second actuating means of a second self-loading system with the trigger in a combination rifle comprising:

an axle coupled with the trigger disposed to provide an axis of rotation for the trigger;

a sleeve mounted on the axle including at least one longitudinally extending gear; and stop means located at the ends of the axle for defining first and second positions for the switch-over mechanism such that, in the first position the gear engages the first actuating means while being disengaged from the second actuating means, and in the second position the gear engages the second actuating means while being disengaged from the first actuating means.

2. An automatic combination rifle including a first caliber rifle system and a second caliber rifle system, the second caliber rifle system having a smaller caliber than the first rifle system and disposed adjacent to the first caliber rifle system, each of the rifle systems being connected to a movable trigger lever, comprising:

a first triggering mechanism with a first release for actuating the first caliber rifle system;

a second triggering mechanism with a second release for actuating the second caliber rifle system; and a change-over mechanism for selectively coupling either the first release or the second release with the trigger lever, the change-over mechanism comprises a transverse axle having the trigger lever pivotally mounted thereto and establishes an interconnection between the trigger lever and a selected one of the first or second releases, the transverse axle is movable in the axial direction between first and second end positions and comprises a section with a non-circular cross section which, in each of the end positions, transmits a moment of torsion between the trigger lever and a selected one of the releases.

3. The invention as in claim 2, wherein the transverse axle has two lateral end portions where at least one of the lateral end portions of the transverse axle projects from a handle housing to present a change-over activation button.

4. The invention as in claim 2, wherein the non-circular cross section has a serration profile.

* * * * *